US005429093A

United States Patent [19]

Fukui et al.

[11] Patent Number: 5,429,093

[45] Date of Patent: Jul. 4, 1995

[54] APPARATUS FOR CONTROLLER INTERNAL COMBUSTION ENGINE

[75] Inventors: Wataru Fukui; Atsuko Hashimoto, both of Himeji, Japan

[73] Assignee: Mitsubishi Denki Kabushiki Kaisha, Tokyo, Japan

[21] Appl. No.: 223,446

[22] Filed: Apr. 5, 1994

[30] Foreign Application Priority Data

Apr. 5, 1993 [JP] Japan ..... 5-078221
Apr. 6, 1993 [JP] Japan ..... 5-079614

[51] Int. Cl.[6] ..... F02P 7/067

[52] U.S. Cl. ..... 123/414; 123/613; 123/643

[58] Field of Search ..... 123/414, 416, 417, 418, 123/612, 613, 617, 643

[56] References Cited

U.S. PATENT DOCUMENTS

| | | | |
|---|---|---|---|
| 4,773,381 | 9/1988 | Koshida | 123/613 |
| 4,979,485 | 12/1990 | Iwata et al. | 123/613 |
| 5,115,792 | 5/1992 | Fukui | 123/613 |
| 5,184,080 | 2/1993 | Remmers | 123/613 |
| 5,325,833 | 7/1994 | Fukui et al. | 123/414 |
| 5,333,586 | 8/1994 | Fukui | 123/414 |
| 5,343,842 | 9/1994 | Fukui | 123/414 |

FOREIGN PATENT DOCUMENTS 5156996 6/1993 Japan .

*Primary Examiner*—Willis R. Wolfe
*Attorney, Agent, or Firm*—Sughrue, Mion, Zinn, Macpeak and Seas

[57] ABSTRACT

An apparatus for controlling an internal combustion engine that automatically corrects an error of a reference position to prevent an erroneous calculation of a controlled-parameter so as to accurately control the internal combustion engine, the apparatus for controlling an internal combustion engine having a period measuring section for measuring a period of a plurality of reference-position areas and a period of a plurality of areas corresponding to cylinders of a reference-position signal, an angular error detection section for detecting an angular error in each reference-position area in accordance with the period of the reference-position areas and the period of the areas corresponding to the cylinders and an error discrimination section that discriminates validity of the angular error to generate a final angular error, wherein a timer control section corrects the controlled-parameter in accordance with the final angular error, and a control time setting section corrects a time controlled by the timer in accordance with the final angular error.

5 Claims, 10 Drawing Sheets

θa' : IGNITION TIMING CRANK ANGLE
Ta' : IGNITION TIMING TIMER CONTROL TIME
D : OPERATIONAL STATE
SGT : REFERENCE-POSITION SIGNAL
ε θ(k) : ANGULAR ERROR
ε θ : SUM OF ERRORS
α1 : STEADINESS DISCRIMINATION VALUE
ε θ'(k) : FINAL ANGULAR ERROR
A : STEADINESS DISCRIMINATION SIGNAL
T(k) : PERIOD OF REFERENCE-POSITION AREAS
T720(k) : PERIOD OF AREAS CORRESPONDING TO CYLINDERS

SGT' : REFERENCE-POSITION SIGNAL
β : CYLINDER DISCRIMINATION VALUE
B : CYLINDER DISCRIMINATION SIGNAL

B80° : REFERENCE POSITION FOR SPECIFIC CYLINDER

T75 : PERIOD OF REFERENCE-POSITION AREAS FOR SPECIFIC CYLINDER

TDC : REFERENCE POSITION FOR SPECIFIC CYLINDER

SGT : REFARENCE-POSITION SIGNAL
D : OPERATIONAL STATE
A : STEADY-STATE DISCRIMINATION SIGNAL
$T_{70}$ : PERIOD OF FIRST AREAS
$T_{110}$ : PERIOD OF SECOND AREAS
$\alpha$ : PERIOD PATIO $\alpha_0$ : STEADY PERIOD RATIO
Ta' : IGNITION TIMING
Tex : PREDICTED PERIOD
Ton : POWER-SUPPLY COMMENCEMENT TIMING
$\theta a$ : CRANK ANGLE AT IGNITION TIMING

APPARATUS FOR CONTROLLER INTERNAL COMBUSTION ENGINE

BACKGROUND OF THE INVENTION

1. Field of the Invention

This invention relates to an apparatus for controlling an internal combustion engine by controlling controlled-parameters (ignition timing and the like) for each cylinder in accordance with the period of reference-position areas in a reference-position signal, and more particularly to an apparatus for controlling an internal combustion engine, the reliability of which is improved by correcting an error of the period of the reference-position areas in the reference-position signal.

2. Description of the Related

In general, an internal combustion engine of a type revolved by a plurality of cylinders through a crank shaft comprises a microcomputer for calculating controlled-parameters (the fuel injection timing, the power supply timing to the ignition coil and the ignition timing and the like) in accordance with a reference-position signal synchronized with the revolutions of the internal combustion engine and the state of running informed from a variety of sensors.

Usually, timing for controlling ignition coils and injectors is, in a steady operational state, controlled by means of a timer in accordance with a reference position denoted by a reference-position signal. Therefore, an angle detection section for generating the reference-position signal is disposed on the crank shaft or the cam shaft of the internal combustion engine in order that first and last transitions of the reference-position signal indicate a predetermined crank angle (the rotational angle of the crank shaft), that is, the reference position.

The first and last transitions of the reference-position signal correspond to the timing, at which power is supplied to the ignition coil, and the ignition timing of the same respectively, which are realized in a start state (at the cranking timing) in which the rotational period is unstable and the operation of an ECU (Electronic Control Unit) is unstable due to the voltage drop.

FIG. 7 is a block diagram of the functions of a conventional internal combustion engine. FIG. 8 is a perspective view of an example of the structure of the angle detection section shown in FIG. 7. FIG. 9 is a graph showing both reference-position signal and a coil current generated by the angle detection section.

Referring to FIG. 7, reference numeral 1 represents a known angle detection section for generating reference-position signal SGT in the form of a pulse, the angle detection section 1 comprising, for example, as shown in FIG. 8: a rotational plate 12 attached to a cam shaft 10 of the internal combustion engine and having slits 11; and a photo-coupler having light receiving devices 13 and 14 respectively facing the slits 11.

The reference-position signal SGT generated by the angle detection section in synchronization with the revolutions of the internal combustion engine rises at reference position B75° (at a position earlier than the top dead center by 75°) and falls at reference position B5° (at a position earlier than the top dead center by 5°) of each cylinder.

Referring to FIG. 9, reference numeral T70 represents a period of areas (positions at each of which the crank angle is 70°) in each of which the level of the reference-position signal SGT is high. Reference numeral T110 represents a period of areas (110°) in each of which the same is low, T180 represents a period of the reference positions, and T720 represents a period of areas corresponding to the cylinders, the period being equivalent to one period (which is 720° because the crank shaft is rotated by two times) corresponding to each cylinder. The pulse of the reference-position signal SGT corresponds to the number of the cylinders such that the pulse correspond to #1, #3, #4 and #2 cylinders if the internal combustion engine has four cylinders.

Symbols Ton represent a period in which the timer controls the timing to correspond to the moment at which the supply of coil current I is commenced. Symbol $\theta a$ represents the crank angle corresponding to the ignition timing and Ta represents a time controlled by the timer and corresponding to the ignition timing. In this case, the reference position for the power supply start timing Ton is B5° and the time Ta controlled by the timer and corresponding to the ignition timing is B75°.

Referring to FIG. 7, reference numeral 2 represents variable sensors for detecting operational state D of the internal combustion engine and comprising a sucked-air quantity sensor, a throttle sensor and a temperature sensor (collectively omitted from illustration). Therefore, the operational state D includes the sucked-air quantity (or the degree of opening of the throttle) indicating the engine load, the revolution speed of the engine and the temperature of the sucked air.

Reference numeral 30 represents the ECU comprising a microcomputer to generate controlled-parameters (the fuel injection timing, the power supply timing, and the ignition timing and the like) for each cylinder in accordance with the reference-position signal SGT and the operational state D. Reference numeral 4 represents a power transistor having a base to which a controlled-parameter signal is supplied from the ECU 3 so that the power transistor 4 is activated/deactivated. Reference numeral 5 represents an ignition coil having a primary coil 5*a* connected to the collector of the power transistor 4. Reference numeral 6 represents a spark plug connected to a secondary coil 5*b* of the ignition coil 5 to sequentially burn mixed gas in each cylinder.

The ECU 30 comprises: a period measuring section 310 for measuring reference-position period T180 in accordance with the reference-position signal SGT; a timer control section 320 for calculating a controlled-parameter, for example, crank angle $\theta a$ at the ignition timing, in accordance with the reference-position signal SGT, the reference-position period T180 and the operational state D; a controlled-time setting section 330 for converting the ignition timing crank angle $\theta a$ into the time Ta controlled by the timer and corresponding to the ignition timing in accordance with the reference-position period T180; and an output interface 390 for supplying the time Ta controlled by the timer and corresponding to the ignition timing to the base of the power transistor 4, the time Ta controlled by the timer and corresponding to the ignition timing being supplied as the controlled-parameter signal.

The ECU 30 activates the power transistor 4 at the power supply start timing Ton (see FIG. 9) to raise the coil current I which flows through the primary coil 5*a* of the ignition coil 5. At the time Ta controlled by the timer and corresponding to the ignition timing, the ECU 30 deactivates the power transistor 4 to interrupt flowing of the coil current I. At the aforesaid timing, the ECU 30 makes the secondary coil 5*b* generate high-potential voltage so that the spark plug 6 discharges a spark.

Although FIG. 7 shows only the time Ta controlled by the timer and corresponding to the ignition timing for the ignition coil 5 as the controlled-parameter, the ECU 30 further generates a controlled-parameter for the injector (omitted from illustration) which corresponds to the fuel injection timing.

The angle detection section 1 may comprise a cylinder identification signal (omitted from illustration) for identifying a specific cylinder among the cylinders.

Referring to FIGS. 8 and 9, the operation of the conventional apparatus for controlling an internal combustion engine shown in FIG. 7 will now be described.

During running of the vehicle, the light receiving device 14 in the angle detection section 1 generates and supplies the reference-position signal SGT formed as shown in FIG. 9 in accordance with the revolutions of the cam shaft 10 of the internal combustion engine to supply the reference-position signal SGT to the ECU 30. Similarly, the various sensors 2 detect the operational state D indicating the number of revolutions and the load and the like and supply the operational state D to the ECU 30.

The period measuring section 310 in the ECU 30 measures the reference-position period T180 whenever it detects the reference position B75° of the reference-position signal SGT.

The timer control section 320 calculates an optimum crank angle $\theta a$ at the ignition timing corresponding to the operational state D by using a provided map in accordance with the reference-position signal SGT and the reference-position period T180. In accordance with the reference-position period T180 and the crank angle $\theta a$ at the ignition timing, the controlled-time setting section 330 calculates the time Ta controlled by the timer and corresponding to the ignition timing (the time controlled by the timer counted from the reference position B75°) corresponding to the ignition timing, as follows:

$$Ta = \theta a \times (T180/180°) \quad (1)$$

As described above, the timer control section 320, by using the map, calculates the optimum ignition timing $\theta a$ with reference to the reference position B75°. The controlled-time setting section 330 calculates the time Ta controlled by the timer and corresponding to the ignition timing in accordance with Equation (1), the time Ta controlled by the timer and corresponding to the ignition timing being formed into the controlled-parameter signal through the output interface 390 and then supplied to the power transistor 4.

Although omitted from illustration in FIG. 7, assumption is made here that the power supply start timing Ton for the ignition coil 5 has been, as the timer controlled-time counted from the reference position B5°, transmitted through the output interface 390 and therefore the coil current I has been raised.

The time Ta controlled by the timer and corresponding to the ignition timing has been, as can be understood from Equation (1), normalized with the reference-position period T180 onto which the state of revolutions of the internal combustion engine are reflected. As a result, the coil current I can be interrupted at an optimum timing corresponding to the state of the revolutions so that the cylinders to be controlled can be ignited.

That is, the power transistor 4 is activated after the controlled time Ton has passed from the moment of the reference position B5° so that the supply of the coil current I is commenced. After the time Ta controlled by the timer and corresponding to the ignition timing has passed from the reference position B75°, the power transistor 4 is deactivated and the coil current I is interrupted so that negative high-potential voltage is generated in the secondary coil 5*b* in accordance with the level of the coil current I realized at the interruption. Then, the high-potential voltage is applied to a space between electrodes of the spark plug 6 so that the spark plug 6 discharges a spark. As a result, the mixed gas in the cylinder, which is the subject to be controlled, is ignited.

However, the angle detection section 1 arranged as shown in FIG. 8 involves errors in the positions of the slits 11 due to scattering occurring when the same is manufactured, and accordingly the pulse edge of the reference-position signal SGT does not always accurately indicate the reference position B75° or 5°.

If the first reference position B75° is, in actual, at a crank angle position of 76° shifted in the advance direction by 1°, the actual ignition timing is undesirably shifted in the advance direction by 1° of the crank angle from an aimed ignition timing because the time Ta controlled by the timer and corresponding to the ignition timing obtainable from Equation (1) is determined on the basis of an assumption that the first reference position is B75°.

That is, the time Ta controlled by the timer and corresponding to the ignition timing does not coincide with a desired crank angle $\theta a$ at the ignition timing because the reference-position period T180 in Equation (1) equivalents to a crank angle of 181°.

It leads to a fact that the ignition is performed at an inaccurate timing shifted in the advance direction while being considerably deviated from the ignition timing calculated by the ECU 30. In this case, there arises a problem in that the internal combustion engine is damaged for example.

Since the conventional apparatus for controlling the internal combustion engine calculates the reference-position period T180 on a basis of an assumption that the reference-position signal SGT indicates the accurate reference positions B75° and B5° and calculates the controlled-parameters (for example, the time Ta controlled by the timer and corresponding to the ignition timing), accurate control cannot be performed if an error takes place in the reference position B75° or B° due to a manufacturing error or the like. For example, a problem rises in that the time Ta controlled by the timer and corresponding to the ignition timing is erroneously controlled, resulting in that the internal combustion engine is damaged.

FIG. 10 is a block diagram of the functions of another conventional apparatus for controlling an internal combustion engine of the foregoing type. FIG. 11 is a graph showing waveforms of a reference-position signal generated by the angle detection section 1 shown in FIG. 10 and a coil current.

Referring to FIG. 10, the structure in the ECU 3 is different from the control apparatus shown in FIG. 7. The residual portions are basically the same as those of the control apparatus shown in FIG. 7.

A reference-position signal SGT generated by the angle detection section 1 in synchronization with the revolutions of the internal combustion engine, as shown in FIG. 11, rises at a first reference position B75° (at a position earlier than the top dead center by 75°) and falls at a second reference position B5° (at a position earlier than the top dead center by 5°) for each cylinder. The reference-position period is 180° of the crank angle.

Referring to FIG. 11, T180 (n−1) represents a previous reference-position period of the first reference positions B75°, T180 (n) represents a present reference-position period, Tex represents a predicated next period, Ton represents a time controlled by a timer corresponding to the timing at which supply of coil current I is commenced, θa represents a crank angle corresponding to the ignition timing and Ta represents a time controlled by the timer and corresponding to the ignition timing. In this case, the reference position for the power-supply commencement timing Ton is the second reference position B5° and the reference position for the time Ta controlled by the timer and corresponding to the ignition timing is the first reference position B75°.

Reference numeral 3 represents an ECU comprising a microcomputer to generate controlled-parameters (the fuel injection timing, the power supply timing, and the ignition timing and the like) for each cylinder in accordance with the reference-position signal SGT and the operational state D.

The ECU 3 comprises: a period measuring section 31 for measuring reference-position period T180 in accordance with the reference-position signal SGT; a controlled-parameter calculating section 320 for controlling the controlled-parameters in accordance with the reference-position signal SGT, the reference-position period T180 and the operational state D; and an output interface 39 for supplying the controlled-parameter to the base of the power transistor 4 as a drive signal.

The controlled-parameter calculating section 32 comprises: a predicted-period calculating section 33 for calculating the next reference-position period, that is, the predicted period Tex, in accordance with change in the reference-position period T180; a timer control section 34 for, by using a map, calculating the power-supply commencement timing Ton and the crank angle θa at the ignition timing to serve as the controlled-parameters in accordance with the reference-position signal SGT, reference-position period T180 and the operational state; and a correction section 35 for calculating to correct the crank angle θa at the ignition timing in accordance with the predicted period Tex so as to transmit the ignition timing Ta.

The controlled-parameter signal supplied from the ECU 3 activates the power transistor 4 at the power-supply timing Ton so that the coil current I, which flows through the primary coil 5a of the ignition coil 5, is raised. The controlled-parameter signal deactivates the power transistor 4 at the time Ta controlled by the timer and corresponding to the ignition timing to interrupt the coil current I so that high-potential voltage is generated in the secondary coil 5b to cause the spark plug 6 to discharge a spark.

Although only the controlled-parameter for the ignition coil 5 has been described here, the ECU 3 further generates, for example, a controlled-parameter for the injector (omitted from illustration) corresponding to the fuel injection timing similarly to the apparatus shown in FIG. 7.

Referring to FIGS. 8 and 11, the operation of the conventional apparatus for controlling an internal combustion engine shown in FIG. 10 will now be described.

During running of the vehicle, the light receiving device 14 in the angle detection section 1 generates and supplies the reference-position signal SGT formed as shown in FIG. 11 in accordance with the revolutions of the cam shaft 10 of the internal combustion engine to supply it to the ECU 3. Similarly, the various sensors 2 detect the operational state D indicating the number of revolutions and the load and the like and supplies the operational state D to the ECU 3.

The reference-position period measuring section 31 in the ECU 3 measures the period as the reference-position period T180 whenever it detects the first reference position B75°.

The predicted-period calculating section 33 in the controlled-parameter calculating section 32 calculates the predicted period Tex in accordance with the previous reference-position period T180 (n−1) and the present position period T180 (n) as follows:

$$Tex = T180\ (n) + K\{T180\ (n) - T180\ (n-1)\} \quad (2)$$

where {T180 (n)−T180 (n−1)} represents a deviation of the period corresponding to change in the revolutions and K represents a prediction weighted coefficient. The prediction weighted coefficient K is set to an optimally matched value corresponding to acceleration characteristics and the like of each internal combustion engine.

As shown in Equation (2), a value obtained by multiplying the deviation of the period with the prediction weighted coefficient K is added to the present position period T180 (n) to be reflected on the predicted period Tex.

Since the deviation of the period is, therefore, a negative value in, for example, the transition operational state during acceleration because T180 (n)<T180 (n−1), the quantity of decrease in the reference-position period T180 is reflected on the predicted period Tex. In a steady operational state in which change in the revolutions is limited, the previous reference-position period T180 (n−1) and the present reference-position period T180 (n) are the same, and therefore, the deviation in the period is made to be substantially zero. Accordingly, the present reference-position period T180 (n) is made to be the predicted period Tex as it is.

Then, the timer control section 34 in the controlled-parameter calculating section 32 calculates optimum power-supply commencement timing Ton and the crank angle θa at the ignition timing corresponding to the operational state D. The correction section 35 calculates to correct the time Ta controlled by the timer and corresponding to the ignition timing (the controlled time from the first reference position B75°) corresponding to the ignition timing in accordance with the crank angle θa at the ignition timing and the predicted period Tex as follows:

$$Ta = \theta a\ (Tex/180°) \quad (3)$$

The crank angle θa at the ignition timing in Equation (3) corresponds to the ignition timing from the controlled reference position (B75°).

As described above, the controlled-parameter calculating section 32, by using a map, obtains the optimum ignition timing θa corresponding to the operational state D with reference to the first reference position B75° (or the second reference position B5°) to calculate the timer control time to the ignition timing, that is, the ignition timing Ta from Equation (3). The ignition timing Ta is transmitted through the output interface 39.

The power supply start timing Ton for the ignition coil 5 has been, as the timer controlled time from the second reference position B5°, transmitted through the output interface 39, and therefore the coil current I has been raised. Therefore, the ignition timing Ta corrected with the predicted period Tex interrupts the coil current I at an optimum timing so that the cylinder, which is the subject to be controlled, can be ignited.

That is, when the supply of the coil current I is commenced after the control time Ton has passed from the second reference position B5° and the power transistor 4 is deactivated after the control time Ta has passed from the first reference position B75° so that the coil current I is interrupted, negative high-potential voltage is applied to the spark plug 6 connected to the secondary coil **5*b* of the ignition coil 5. Therefore, discharge takes place between the electrodes of the spark plug 6** of the cylinder, the ignition of which is the subject to be controlled, so that the mixed gas in the cylinder to be subjected is ignited.

However, the angle detection section 1 in the apparatus for controlling an internal combustion engine as well as involves errors in the positions of the slits 11 due to scattering occurring when the same is manufactured, and accordingly the pulse edge of the reference-position signal SGT does not always accurately indicate the reference position B75° or 5°.

If the first reference position B75° is, in actual, at crank angle position 76° shifted in the advance direction by 1°, the actual ignition timing is undesirably shifted in the advance direction by 1° of the crank angle from an aimed ignition timing because the time Ta controlled by the timer and corresponding to the ignition timing obtainable from Equation (3) is determined on the basis of an assumption that the first reference position is B75°.

It leads to a fact that the ignition is performed at an inaccurate timing shifted in the advance direction while being considerably deviated from the ignition timing calculated by the ECU 3. In this case, there arises a problem in that the internal combustion engine is damaged for example.

Since the conventional apparatus for controlling an internal combustion engine has been arranged in this way that the predicted period Tex is calculated and the controlled-parameter for the ignition coil 5 is obtained on the basis of an assumption that the reference-position signal SGT accurately indicates the reference positions B75° and B5°, the apparatus cannot precisely control the internal combustion engine similarly to the foregoing control apparatus if the reference position B75° or B5° includes an error due to a manufacturing error or the like. Accordingly, there arises a problem in that the controlled-parameter, for example, the time Ta controlled by the timer and corresponding to the ignition timing is erroneously controlled and therefore the internal combustion engine can be damaged.

SUMMARY OF THE INVENTION

The present invention is directed to overcome the foregoing problems and an object of the present invention is to provide an apparatus for controlling an internal combustion engine that automatically corrects an error of a reference position in accordance with a reference-position signal in a steady operation mode to prevent an erroneous calculation of a controlled-parameter so as to accurately control the internal combustion engine.

According to a first aspect of the present invention, there is provided an apparatus for controlling an internal combustion engine comprising: ignition coils for sequentially burning mixed gas in a plurality of cylinders for rotating the internal combustion engine; angle detection means for generating a reference-position signal indicating a reference position corresponding to a reference crank angle for each of the cylinders; a variety of sensors for detecting a state of operation of the internal combustion engine; timer control means for setting a controlled-parameter for the internal combustion engine in accordance with the reference-position signal and the state of operation; controlled-time setting means for converting the controlled-parameter into a time controlled by a timer; period measuring means for measuring a period of a plurality of reference-position areas of the reference-position signal and a plurality of area periods corresponding to the cylinders; angular error detection means for detecting an angular error of each reference-position area in accordance with the reference-position area period and the area period corresponding to the cylinder; and error discrimination means for discriminating the validity of the angular error to generate a final angular error, wherein the timer control means corrects the controlled-parameter in accordance with the final angular error, and the controlled-time setting means corrects the time controlled by the timer in accordance with the final angular error.

According to a second aspect of the present invention, there is provided an apparatus for controlling an internal combustion engine according to the first aspect wherein the error discrimination means includes storage means for storing the plural angular errors while updating the angular errors, addition means that adds the angular errors in the area periods corresponding to the cylinders to generate a sum of the errors, comparison means for generating a steadiness discrimination signal if the sum of the errors is smaller than a steadiness discrimination value and output means that responds to the steadiness discrimination signal to transmit contents of the storage means as a final angular error.

According to a third aspect of the present invention, there is provided an apparatus for controlling an internal combustion engine according to the first or second aspect of the present invention further comprising: cylinder discrimination means for generating a cylinder discrimination signal in accordance with the angular error, wherein the cylinder discrimination means includes comparison means for generating the cylinder discrimination signal if the angular error is larger than a cylinder discrimination value, at least one of the reference-position area periods of the reference-position signal relating to a specific cylinder is different from the reference-position area period of other cylinders and the timer control means identifies each cylinder in accordance with the cylinder discrimination signal.

According to a fourth aspect of the present invention, there is provided an apparatus for controlling an internal combustion engine comprising: ignition coils for sequentially burning mixed gas in a plurality of cylinders for rotating the internal combustion engine; angle detection means for generating a reference-position signal indicating a first reference position and a second reference position corresponding to a reference crank position of each of the cylinders; a variety of sensors for detecting a state of operation of the internal combustion engine; controlled-parameter calculating means for setting a controlled-parameter for the ignition coil in accordance with the reference-position signal and the state of operation; first-area-period measuring means for measuring a first area period from the first reference position to the second reference position; second-area-period measuring means for measuring a second area period from the second reference position to the first reference position; steadiness discrimination means for discriminating a steady state of the internal combustion engine in accordance with at least any one of the first area period, the second area period and the state of operation; and period ratio calculating means for calculating a period ratio of the first area period and the second area period and obtaining a period ratio of the internal combustion engine in a steady state as a steady period ratio, wherein the controlled-parameter calculating means includes predicted-period calculating means for calculating a predicted period in accordance with the first area period, the second area period, the period ratio and the steady period ratio and correction means for correcting the controlled-parameter in accordance with the predicted period.

The first aspect of the present invention has an arrangement that an angular error in each period of the reference-position areas of the reference-position signal is detected so as to correct the controlled-parameter to compensate the angular error in each reference-position area in accordance with the final angular error which has been discriminated to be correct.

The second aspect of the present invention has an arrangement that the angular errors are stored while being sequentially updated and each angular error realized when the sum of the angular errors in the period of the areas corresponding to the cylinders is smaller than the steadiness discrimination value is supplied to the timer control means as a final angular error.

The third aspect of the present invention has an arrangement that each angular error is subjected to a comparison with the cylinder discrimination value, and a cylinder corresponding the reference-position period having an angular error larger than the cylinder discrimination value is identified as a specific cylinder.

The fourth aspect of the present invention has an arrangement that the reference-position error is obtained as an offset in accordance with the steady period ratio of the first area period and the second area period in a steady state to correct the controlled-parameter in this way that the reference-position error is compensated.

DESCRIPTION OF THE PREFERRED EMBODIMENT

First Embodiment

Figure 1:
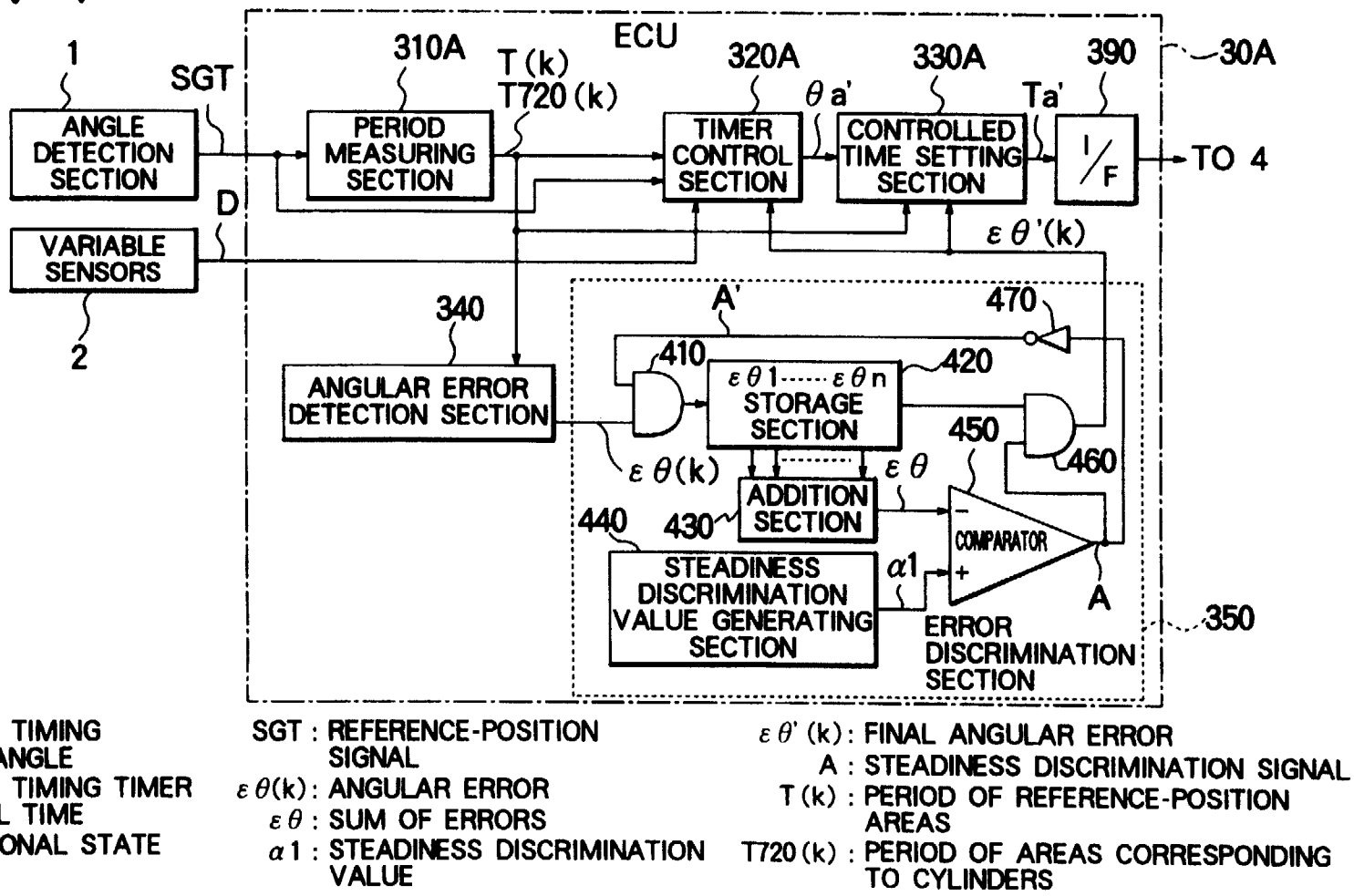
FIG. 1 is a block diagram of functions showing a first embodiment of the present invention.
Figure 7:
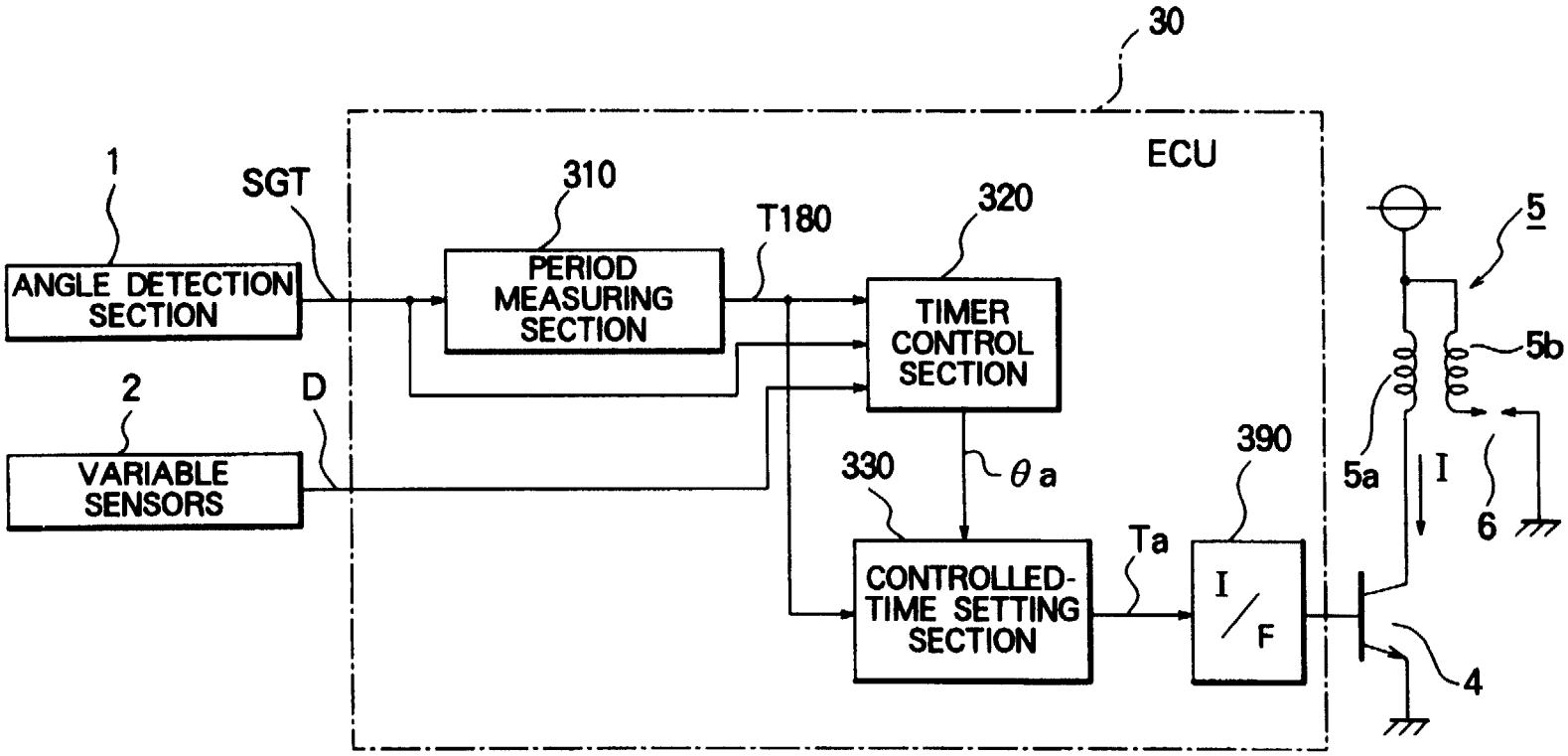
FIG. 7 is a block diagram of functions showing a conventional internal combustion engine.

A first embodiment of the present invention will now be described with reference to the drawings. FIG. 1 is a block diagram showing functions of the first embodiment of the present invention. Reference numerals and symbols 1, 2, 390, SGT, D and I are the same as those of the conventional apparatus shown in FIG. 7. Further, reference numerals and symbols 30A, 310A, 320A, 330A, $\theta a'$ and Ta' respectively correspond to the ECU 30, the period measuring section 310, the timer control section 320, the controlled-time setting section 330, the crank angle $\theta a$ at the ignition timing and the time Ta controlled by the timer and corresponding to the ignition timing of the conventional apparatus. Although omitted from illustration, the power transistor 4 to the spark plug 6 are arranged as shown in FIG. 7.

In this case, a period measuring section 310A measures period T (k) of each reference-position area (high level areas and low level areas of the reference-position signal SGT) and measures period T720 (k) of areas corresponding to the cylinders.

Figure 2:
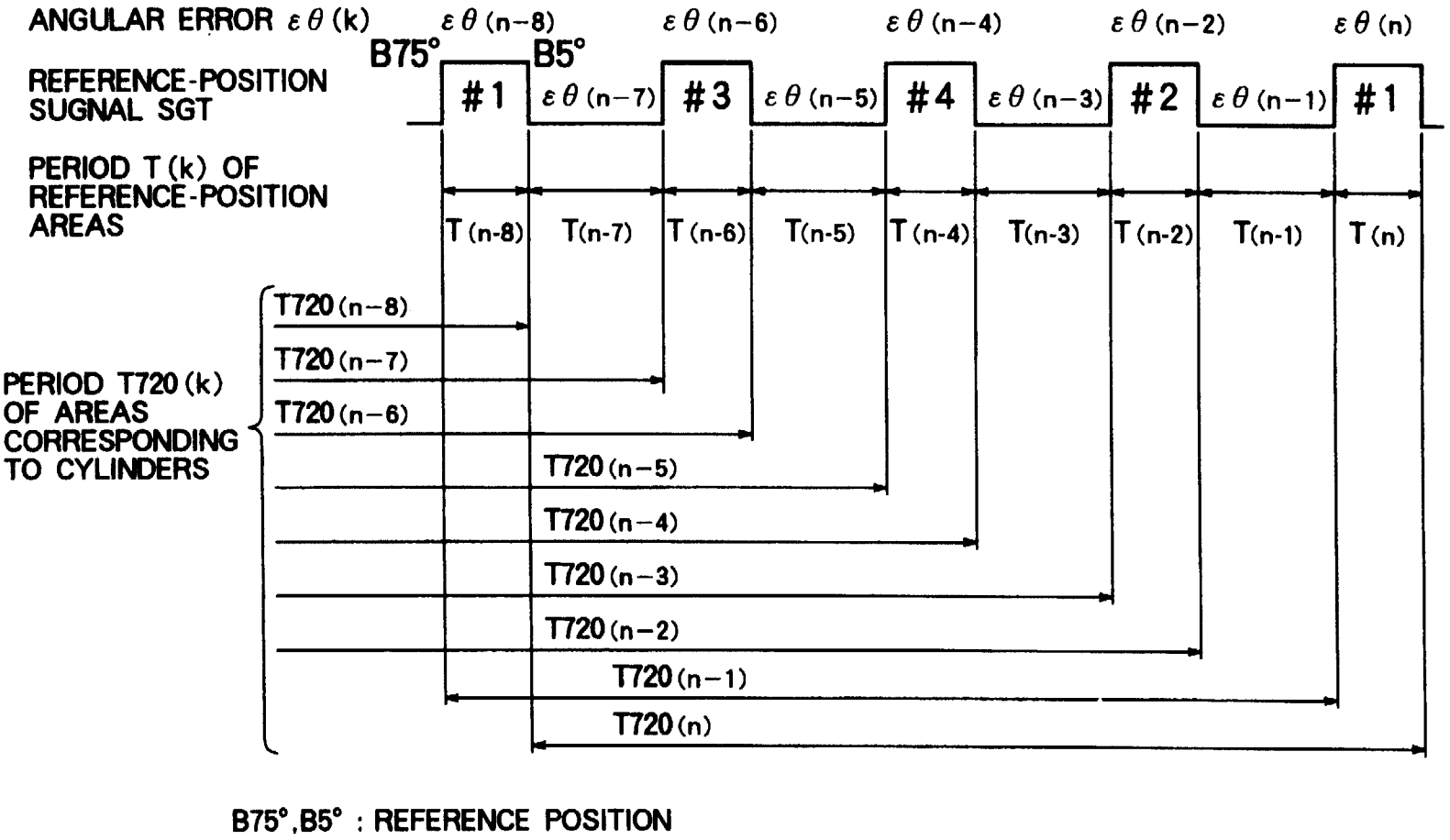
FIG. 2 is a graph of waveforms showing the operation of the first embodiment of the present invention.

FIG. 2 is a graph showing the reference-position signal SGT realized in a case where the internal combustion engine has four cylinders, in which k in the reference-position area period T (k) and the period T720 (k) of areas corresponding to the cylinders, which correspond to the area corresponding to each cylinder, is n−8, n−7, . . . , n. Symbols $\epsilon\ \theta$ (k) represents an angular error included in each reference-position area corresponding to the reference-position area period T (k).

Referring to FIG. 1, the timer control section 320A calculates the crank angle $\theta a'$ at the ignition timing to serve as the controlled-parameter in accordance with the reference-position signal SGT, the operational state D, the reference-position area period T (k), the period T720 (k) of areas corresponding to the cylinders and final angular error $\epsilon\ \theta'$ (k) (to be described later). The controlled-time setting section 330A converts the crank angle $\theta a'$ at the ignition timing into the time Ta' controlled by the timer and corresponding to the ignition timing in accordance with the reference-position area period T (k) and the final angular error $\epsilon\ \theta'$ (k).

The ECU 30A comprises the following elements 340 and 350. Reference numeral 340 represents an angular error detection section for detecting the angular error $\epsilon\ \theta$ (k) in accordance with the reference-position area period T (k) and the period T720 (k) of areas corresponding to the cylinders. Reference numeral 350 represents an error discriminating section that discriminates the validity of the angular error $\epsilon\ \theta$ (k) to generate the final angular error $\epsilon\ \theta'$ (k). The final angular error $\epsilon\ \theta'$ (k) is received by the timer control section 320A and the controlled-time setting section 330A.

The error discriminating section 350 comprises: an AND gate 410 for allowing the angular error $\epsilon\ \theta$ (k) to pass through in response to an inversion signal (to be described later) of a steadiness discrimination signal; a storage section 420 for storing a plurality of angular errors $\epsilon\ \theta$ (k) while updating them; an adder section 430 that adds angular errors between the periods T720 (k) of areas corresponding to the cylinders to generate sum $\epsilon\ \theta$ of the errors; a steadiness discrimination value generating section 440 for generating steadiness discrimination value $\alpha 1$ (for example, about 1°) serving as a reference for discriminating a steady state in which the number of revolutions is constant; a comparison section 450 for generating steadiness discrimination signal A if the sum of the errors angular error $\epsilon\ \theta$ is smaller than the steadiness discrimination value $\alpha 1$; an AND gate 460 (a transmitting section) for transmitting the contents in the storage section 420 as the final angular error $\epsilon\ \theta'$ (k) in response to the steadiness discrimination signal A; and an inverter 470 for inverting the steadiness discrimination signal A.

The steadiness discrimination signal A is supplied to one of input terminals of the AND gate 460 to open the AND gate 460 if a steady-state has been discriminated. Simultaneously, the steadiness discrimination signal A' inverted by the inverter 470 is supplied to one of the input terminals of the AND gate 410 to close the AND gate 410 if a steady-state has been discriminated.

Referring to FIG. 2, the operation of the first embodiment of the present invention shown in FIG. 1 will now be described.

When the reference-position signal SGT from the angle detection section 1 and the operational state D from the various sensors 2 have been supplied to the ECU 3A, the period measuring section 310A in the ECU 3A sequentially measures the reference-position area periods T (k) in the areas in which the level of the reference-position signal SGT is high or low, the period measuring section 310A sequentially measuring the periods T720 (k) of areas corresponding to the cylinders.

The angular-error detection section 340 detects the angular error $\epsilon\ \theta$ (k) as follows in accordance with the reference-position area period T (k) and the period T720 (k) of areas corresponding to the cylinders:

$$\epsilon\ \theta\ (k) = \{T\ (k)/T720\ (k)\} \times 720° - \theta\ (k) \tag{4}$$

where {T (k)/T720 (k)}×720° represents a crank angle in the reference-position area period T (k) normalized with the period T720 (k) of areas corresponding to the cylinders and $\theta$ (k) represent a crank angle in each reference-position area which is 70° if the level of the reference-position area is high and which is 110° if the same is low.

The angular error $\epsilon\ \theta$ (k) obtained from Equation (4) is supplied to the error discriminating section 350 and sequentially stored in the storage section 420 through the AND gate 410. Therefore, the storage section 420 always stores the angular error $\epsilon\ \theta$ (k) between the latest periods T720 (k) of areas corresponding to the cylinders.

Then, the adder section 430 adds the angular errors $\epsilon\ \theta$ (k) stored in the storage section 420 and corresponding to period T720 (k) of areas corresponding to the cylinders to calculate the sum $\epsilon\ \theta$ of errors. The sum $\epsilon\ \theta$ of errors is expressed by the absolute value of the summation formula from n−7 to k=n as follows:

$$\epsilon\ \theta = |\Sigma\ \epsilon\ \theta\ (k)| \tag{5}$$

Then, the comparator 450 subjects the sum $\epsilon\ \theta$ of errors and steadiness discrimination value $\alpha 1$ to a comparison. If the sum $\epsilon\ \theta$ of errors is smaller than the steadiness discrimination value $\alpha 1$, the comparator discriminates that the internal combustion engine is in a steady state in which the number of revolutions is constant, and generates the high-level steadiness discrimination signal A.

The reason for this will now be described: since the period T720 (k) of areas corresponding to the cylinders always corresponds to the crank angle of 720° regardless of each reference-position error because the period T720 (k) of areas corresponding to the cylinders is the pulse period of the reference-position signal SGT for the same cylinder, and therefore the sum $\epsilon\ \theta$ of errors for the period T720 (k) of areas corresponding to the cylinders in a steady state is made to be zero theoretically.

Therefore, a case where the steadiness discrimination signal A is generated by the comparator 450 is discriminated that the each angular error $\epsilon\ \theta$ (k) in the storage section 420 does not indicate the accurate angular error in a steady state. At this time, the inverted steadiness discrimination signal A' acts to close the AND gate 410 so that the supply of the ensuing angular errors $\epsilon\ \theta$ (k) to the storage section 420 is inhibited. Further, the inverted steadiness discrimination signal A' opens the AND gate 460 so as to supply the angular error $\epsilon\ \theta$ (k) in the storage section 420 serving as the final angular error $\epsilon\ \theta'$ (k) to the timer control section 320A and the controlled-time setting section 330A.

The timer setting section 320A adds the angular error $\epsilon\ \theta'$ (k) corresponding to the reference position for the crank angle $\theta$a at the ignition timing to the crank angle $\theta$a at the ignition timing obtained in accordance with the reference-position signal SGT and operational state D so as to generate corrected crank angle $\theta$a' at the ignition timing.

If the first transition of the reference-position area pulse corresponding to the reference-position area period T (n−8) is at the reference position for the controlled time, the crank angle $\theta$a' at the ignition timing is expressed as follows:

$$\theta a' = \theta a + \epsilon\ \theta'\ (n-8) \tag{6}$$

Then, the controlled-time setting section 330A converts the crank angle $\theta$a' at the ignition timing to the time Ta' controlled by the timer and corresponding to the ignition timing while correcting the crank angle $\theta$a' at the ignition timing with the final angular error $\epsilon\ \theta'$ (k).

At this time, two adjacent reference-position area periods T (k) and T (k+1) are used to obtain the reference-position period T180 corresponding to the sum of the periods T70 and T110. The angular error for the reference-position period T180 is obtained as the sum of the two adjacent angular errors $\epsilon\ \theta'$ (k) and $\epsilon\ \theta''$(k+1).

Therefore, in a case where the first transition of the reference-position area pulse corresponding to reference-position area period T (n−8) is at the controlled reference-position, the corrected time Ta' controlled by the timer and corresponding to the ignition timing is expressed as follows in accordance with the foregoing Equation (1):

$$Ta' = \theta a' \times [\{T(n-8) + T(n-7)\}/\{180° + \epsilon\,\theta'(n-8) + \epsilon\,\theta'(n-7)\}] \quad (7)$$

Thus, the controlled-time setting section 330A is able to calculate the accurate time Ta' controlled by the timer and corresponding to the ignition timing in which the error of the reference-position area period T (k) is compensated.

The time Ta' controlled by the timer and corresponding to the ignition timing is, together with the power-supply commencement timing Ton, supplied to the power transistor 4. As a result, the cylinder, which is the subject to be controlled, can be ignited at a desired crank angle $\theta a'$ at the ignition timing calculated by the timer control section 320A. Thus, the cylinder is not controlled at the ignition timing with an abnormal advance, and therefore the damage of the internal combustion engine can be prevented.

Second Embodiment

Although a particular description has not been made about the identification of cylinders in the first embodiment, setting of an offset to the pulse width of the reference-position signal SGT corresponding to a specific cylinder enables the cylinders to be identified in accordance with the angular error $\epsilon\,\theta$ (k).

Figure 3:
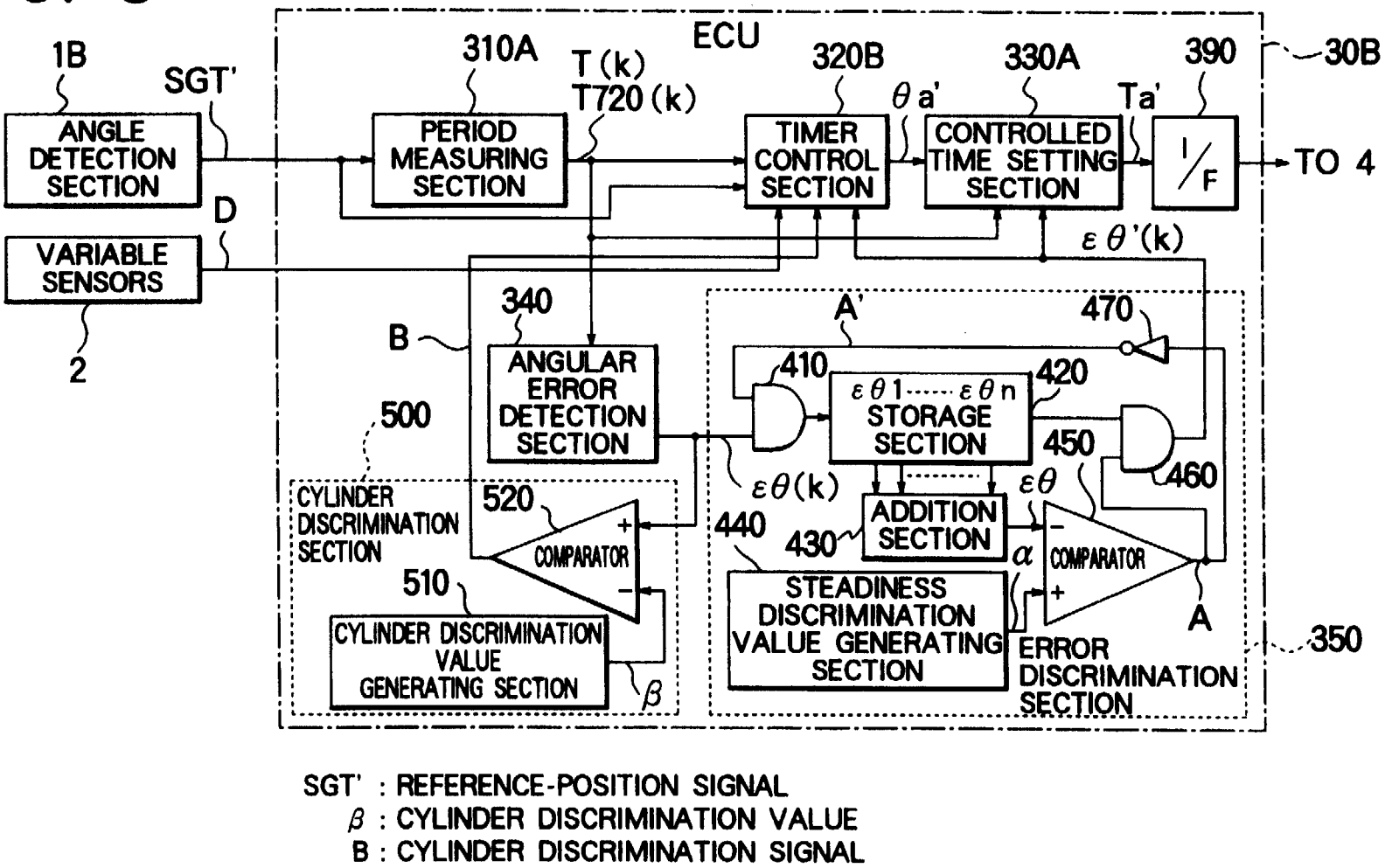
FIG. 3 is a block diagram of functions showing a second embodiment of the present invention.

FIG. 3 is a block diagram showing a second embodiment (corresponding to a third aspect of the present invention) of the present invention, in which reference numerals and symbols 1B, SGT', 30B and 320B respectively correspond to the angle detection section 1, the reference-position signal SGT, the ECU 30A and the timer control section 320A shown in FIG. 1.

Figure 4A:
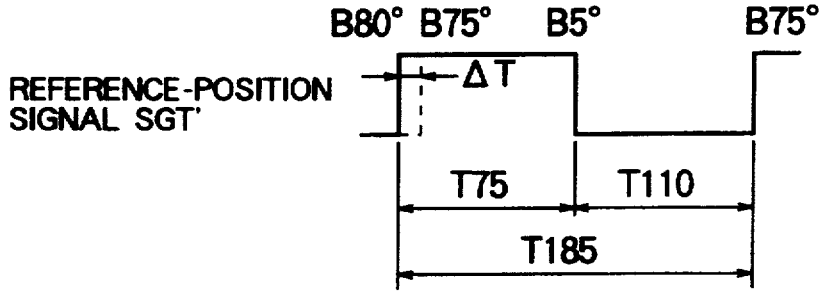
FIGS. 4A and 4B are graphs of the waveform of reference-position signal SGT' in the second embodiment of the present invention.
Figure 4B:
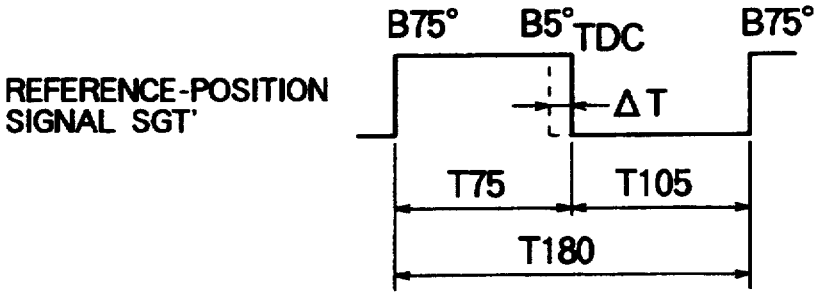

FIGS. 4A and 4B are graphs showing the waveform of the reference-position signal SGT' having the offset which has been set to only the pulse width corresponding to a specific cylinder, in which $\Delta T$ is a crank angle corresponding to the offset.

Referring to FIG. 3, the timer control section 320B is arranged to identify the cylinders in accordance with a cylinder discrimination signal B (to be described later). The ECU 30B comprises the following element 500.

Reference numeral 500 represents a cylinder discrimination section for generating the cylinder discrimination signal B in accordance with the angular error $\epsilon\,\theta$ (k), the cylinder discrimination section 500 comprising: a cylinder discrimination value generating section 510 for generating cylinder discrimination value $\beta$ (for example, about 3°) serving as a reference for discriminating the cylinder; and a comparator 520 that subjects the absolute value $|\epsilon\,\theta\,(k)|$ of the angular error and the cylinder discrimination value $\beta$ to a comparison to generate the cylinder discrimination signal B if the absolute value $|\epsilon\,\theta\,(k)|$ of the angular error is larger than the cylinder discrimination value $\beta$.

In this case, the high-level width of the pulse of the reference-position signal SGT' corresponding to a specific cylinder is, as shown in FIGS. 4A and 4B, set to be longer by the offset quantity $\Delta T$ (5° in crank angle) in this way that the first transition of the pulse is set to B80° (those for the other cylinders are set to B75°) in the case shown in FIG. 4A and that the last transition of the pulse is set to B0°, that is, TDC (those for the other cylinders are set to B5°) in the case shown in FIG. 4B.

Therefore, the reference-position area period T75 of a high-level pulse relating to a specific cylinder is set to be longer than the reference-position area period T70 of the other cylinders. However, the reference-position area period T105 for a specific cylinder is, in the low-level area, shorter than the reference-position area period T110 for the other cylinders.

Although the arrangements shown in FIGS. 4A and 4B is such that the reference-position area period T75 of the highlevel pulse relating to a specific cylinder is set to be longer than that for the other cylinders, it may be made to be shorter.

Referring to FIG. 3, the comparator 520 subjects the absolute value $|\epsilon\,\theta\,(k)|$ of the angular error and the cylinder discrimination value $\beta$ to a comparison. If $|\epsilon\,\theta\,(k)| > \beta$, the cylinder discrimination signal B is generated which denotes that the cylinder relating to the reference-position area period having the angular error $\epsilon\,\theta$ (k) is the specific cylinder.

The cylinder discrimination signal B is supplied to the timer control section 320B so that the timer control section 320B is able to assuredly discriminate each cylinder and calculate the controlled-parameter for each cylinder.

Figure 8:
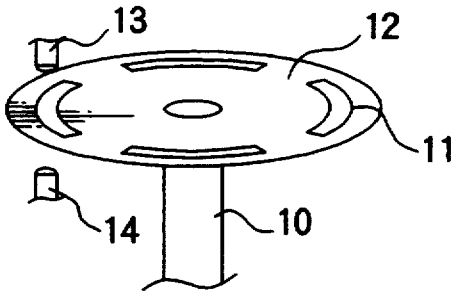
FIG. 8 is a perspective view of the structure of a general angle-detection section.
Figure 9:
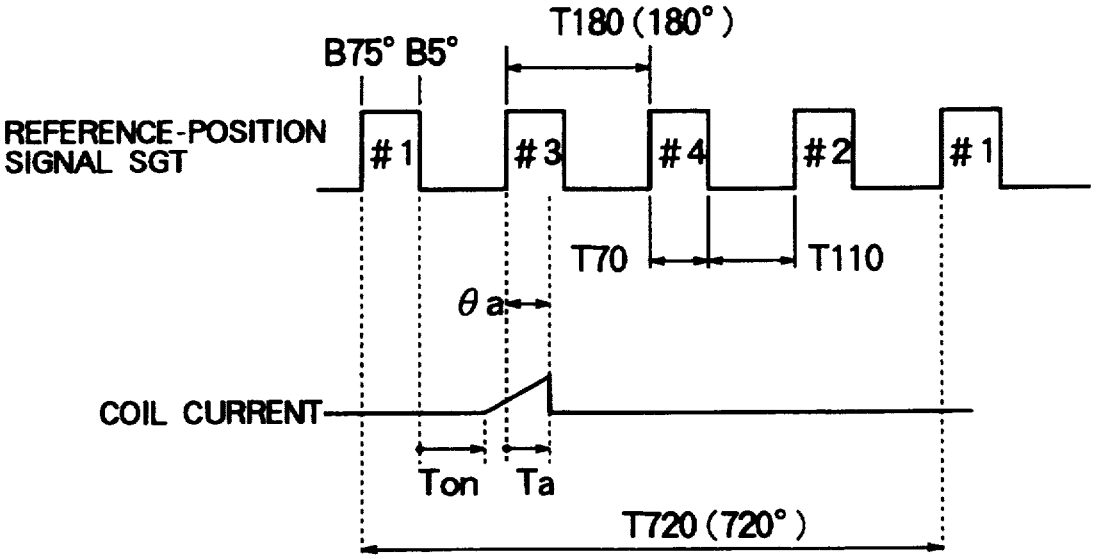
FIG. 9 is a graph of waveforms showing the operation of the conventional apparatus shown in FIG. 7.

In this case, angular-error detection section 1B is required to have an arrangement that only the slit 11 (see FIG. 8), which corresponds to the specific cylinder, is longer (or shorter) by a length corresponding to the offset quantity $\Delta T$. Therefore, the necessity of individually generating the cylinder identifying signal can be eliminated.

Even if an absolute value $|\epsilon\,\theta'\,(k)|$ is larger than the cylinder discrimination value $\beta$, the timer control section 320B and the controlled-time setting section 330A are able to calculate the crank angle $\theta a'$ at the ignition timing and the time Ta' controlled by the timer and corresponding to the ignition timing by using Equations (6) and (7) regardless of the magnitude of the absolute value of the angular error $\epsilon\,\theta$ (k). Therefore, the software in the ECU 30B can be simplified.

Although the second embodiment has the arrangement that the angular error $\epsilon\,\theta$ (k) corresponding to the offset quantity $\Delta T$ is set to 5° and the cylinder discrimination value $\beta$ is set to 3°, the offset quantity $\Delta T$ may, of course, be set to a value in a range which does not arise a manufacturing problem and a problem in controlling the timing.

Although the first and second embodiments have been described about the reference-position signal SGT or SGT' in an example case where the internal combustion engine has four cylinders, similar operation and effects can be obtained if the internal combustion engine has another number of cylinders.

Although the crank angle $\theta a'$ at the ignition timing and the time Ta' controlled by the timer and corresponding to the ignition timing are calculated as the controlled-parameters, similar effects can be obtained in a case where the fuel injection timing to be set for the injector and the timing at which the power supply to the ignition coil 5 is commenced are calculated.

Third Embodiment

Figure 5:
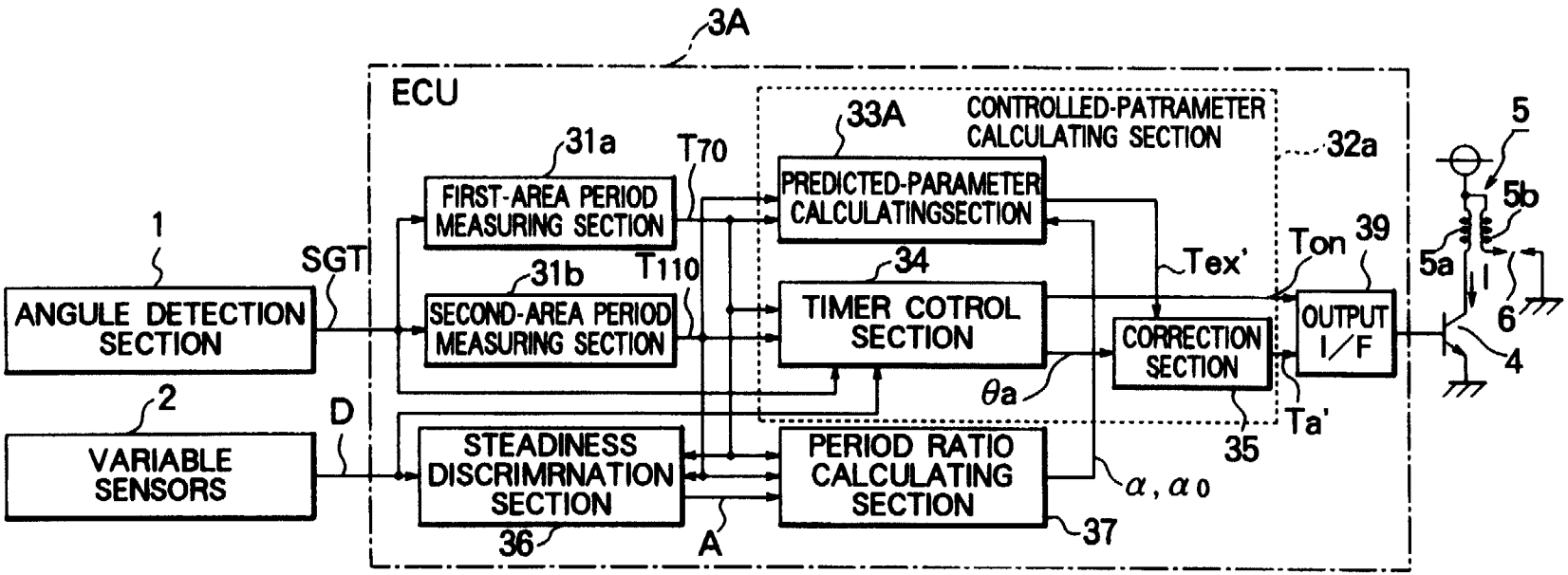
FIG. 5 is a block diagram of functions showing a third embodiment of the present invention.
Figure 10:
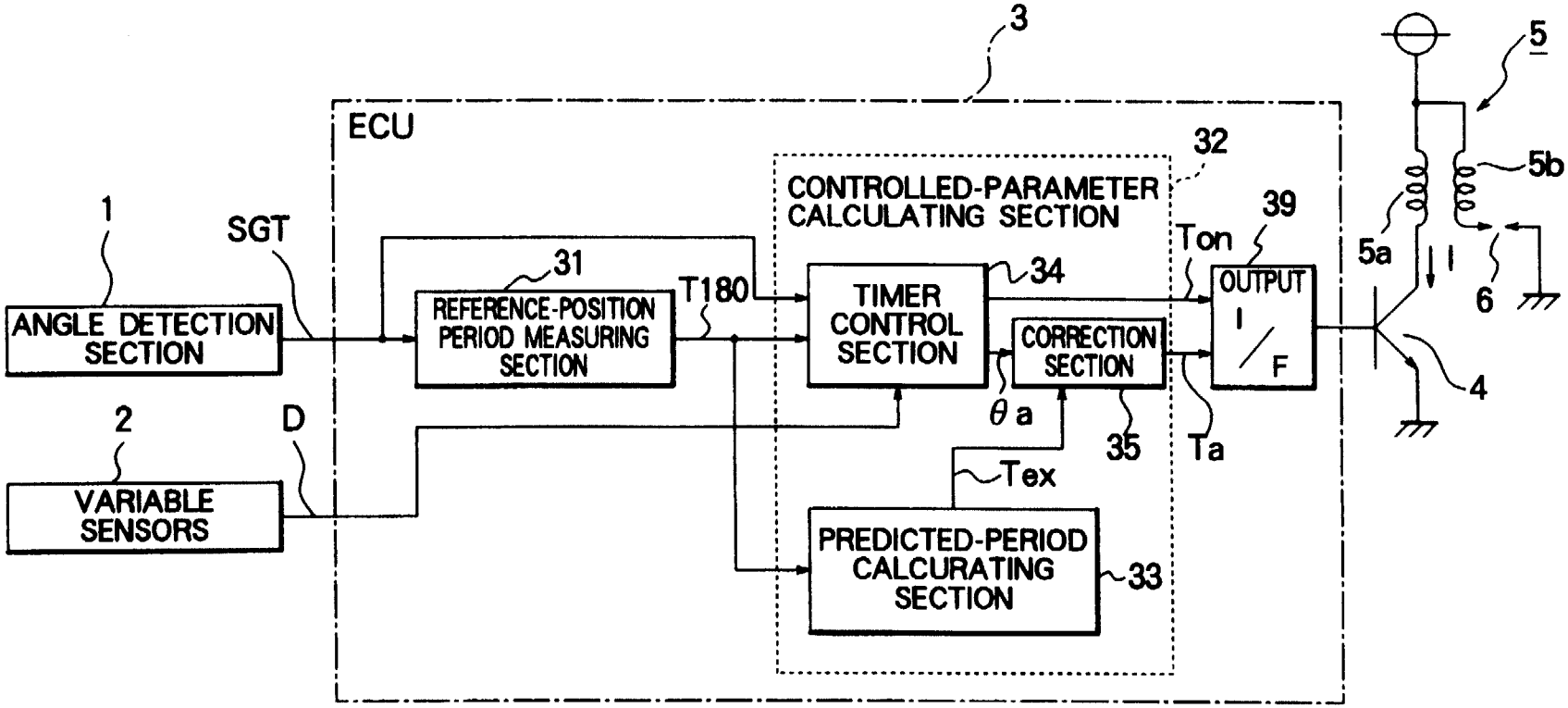
FIG. 10 is a block diagram of functions showing another conventional apparatus for controlling an internal combustion engine.
Figure 11:
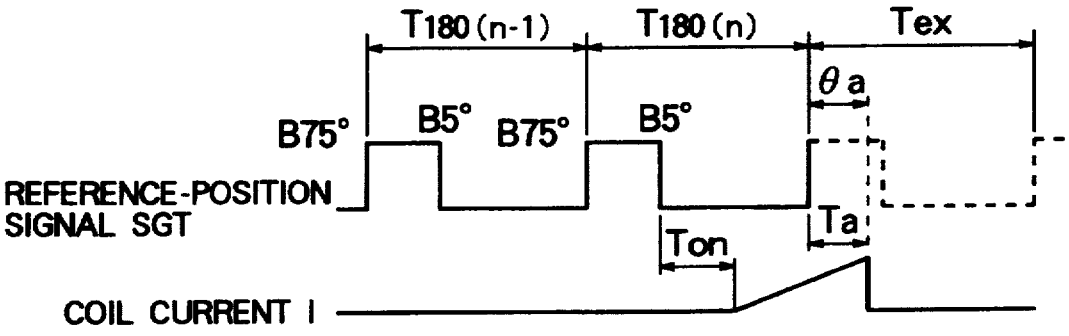
FIG. 11 is a graph of waveforms showing the operation of the conventional apparatus shown in FIG. 10.

FIG. 5 is a diagram showing the functions of a third embodiment of the present invention, in which 1, 2, 34, 45, 39, 4 to 6, SGT, D, Ton and 1 are the same as those of the conventional apparatus shown in FIG. 10. Elements **31*a* and 31*b* correspond to the reference-position period measuring section 31. Elements 3A, 32A, 33A, Tex' and Ta' correspond to the ECU 3, the controlled-parameter calculating section 32, the predicted-period calculating section 33**, the predicted period Tex and the time Ta' controlled by the timer and corresponding to the ignition timing.

In this case, the reference-position period measuring section comprises: a first area period measuring section 31a for measuring a first area period T70 from the first reference position B75° to the second reference position B5° (an area in which the level of the reference-position signal SGT is high); and a second area period measuring section 31b for measuring a second area period T110 from the second reference position B5° to the first reference position B75° (an area in which the level of the reference-position signal SGT is low).

The predicted-period calculating section 33A in the controlled-parameter calculating section 32A calculates the predicted period Tex in accordance with a period ratio and a steady period ratio as well as the sum (corresponds to the reference-position period T180) of the first area period T70 and the second area period T110.

The timer control section 34 sets the power-supply commencement timing Ton and the crank angle θa at the ignition timing serving as controlled-parameters in accordance with the first area period T70, the second area period T110, the reference-position signal SGT and the operational state D. The correction section 35 calculates the crank angle θa at the ignition timing to correct it in accordance with the predicted period Tex' so as to transmit the corrected time Ta' controlled by the timer and corresponding to the ignition timing serving as a controlled-parameter.

Further, ECU 3A comprises the following elements 36 and 37.

Reference numeral 36 represents a steadiness discrimination section for discriminating a steady state in which change in the revolutions is limited. The steadiness discrimination section 36 generates a steady-state discrimination signal A indicating a steady state in accordance with at least any one of the first area period T70, the second area period T110 and the operational state D.

Reference numeral 37 represents a periodic-ratio calculating section for calculating the period ratio of the first area period T70 and the second area period T110. The periodic-ratio calculating section 37 calculates period ratio a in a usual operation mode including the transient operation. Moreover, the periodic-ratio calculating section 37 obtains steady period ratio αo of the internal combustion engine in a steady state in response to the steadiness discrimination signal A. The period ratio α in the usual operation and the steady period ratio αo in the steady state are supplied to the predicted-period calculating section 33A in the parameter calculating section 32A.

Figure 6:
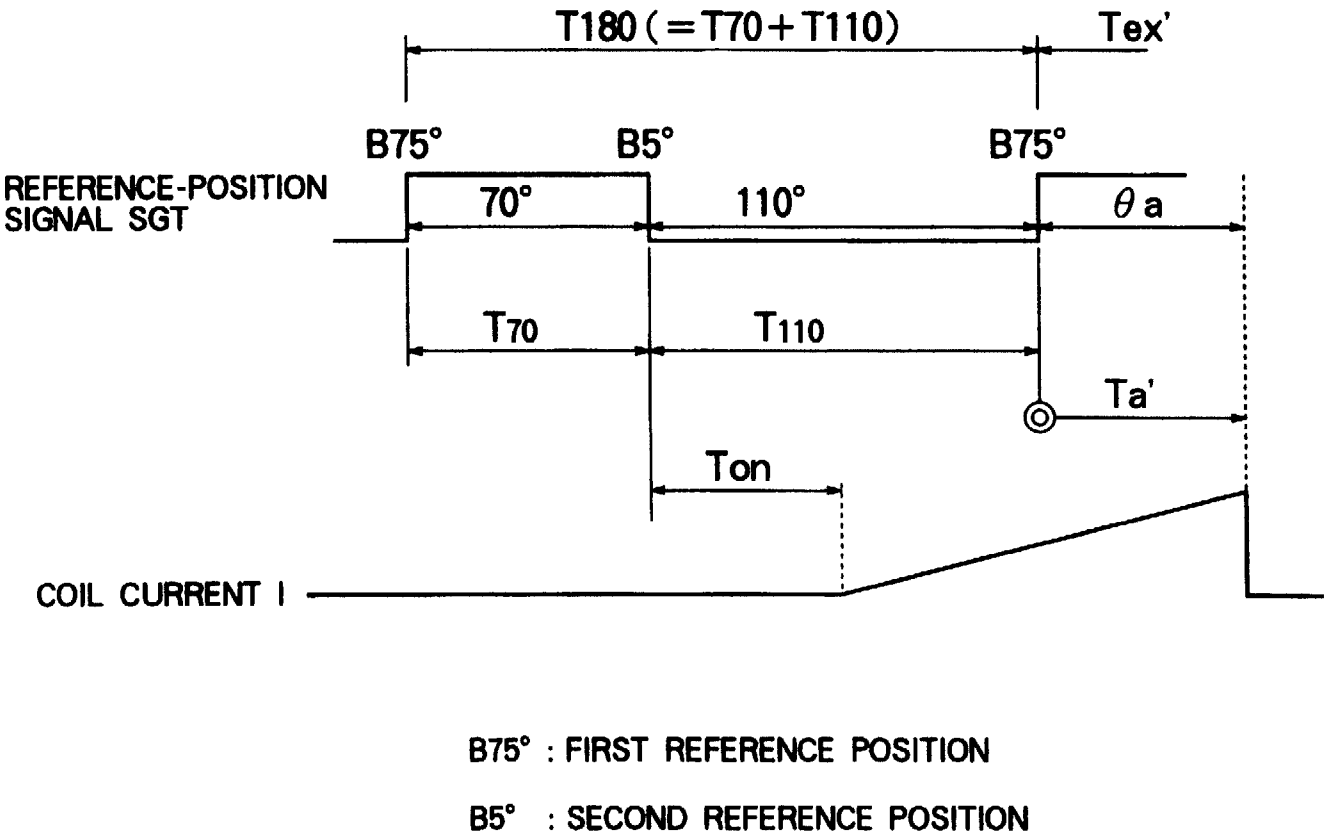
FIG. 6 is a graph of waveforms showing the operation of the third embodiment of the present invention.

FIG. 6 is a graph showing waveforms to illustrate the operation of the third embodiment for calculating time Ta' controlled by the timer and corresponding to the ignition timing (corresponding to the crank angle θa at the ignition timing) while using the first reference position B75° as the reference for the control similarly to the foregoing embodiments.

As shown in FIG. 6, the first area period T70 corresponds to an area in which the level of the reference-position signal SGT is high (in which the crank angle is 70°). The second area period T110 corresponds to an area in which the level of the reference-position signal SGT is low (in which the crank angle is 110°).

Referring to FIG. 6, the operation of the third embodiment of the present invention shown in FIG. 5 will now be described.

When the reference-position signal SGT from the angle detection section 1 and the operational state D from the various sensors 2 have been received by the ECU 3A, the first-area period measuring section 31a measures the first area period T70 in which the level of the reference-position signal SGT is high. The second-area period measuring section 31b measures the second area period T110 in which the level of the reference-position signal SGT is low.

The timer control section 34 in the controlled-parameter calculating section 32A, by using a map, calculating an optimum power-supply commencement timing Ton and the crank angle θa at the ignition timing in accordance with the reference-position signal SGT and the operational state D similarly to the foregoing embodiments so as to supply the crank angle θa at the ignition timing to the correction section.

On the other hand, the steadiness discrimination section 36 discriminates that the present state is a steady state, in which the change in the revolutions is limited, if the change between the previous value and the present value of the first area period T70 or the second area period T110 is smaller than a predetermined value so that the steadiness discrimination section 36 transmits the steadiness discrimination signal A.

The periodic-ratio calculating section 37 calculates the period ratio α as follows in accordance with the first area period T70 and the second area period T110:

$$\alpha=(T110/T70)\times(7/11) \quad (8)$$

Assuming that each of the first reference positions B75° and B5° indicated by the reference-position signal SGT has no error, the value of the period ratio α is 1 in a constant-speed state.

The periodic-ratio calculating section 37 stores the period ratio α calculated when the steadiness discrimination signal A is being generated by the steadiness discrimination section 36, the period ratio α being stored as the steady period ratio αo in a steady state of the internal combustion engine.

If the reference-position signal SGT indicates the accurate reference position B75° or B5°, the steady period ratio αo is 1. If the first reference position B75° is at an advanced crank angle position of B76° due to, for example, a manufacturing error, the steady period ratio αo is smaller than 1 as follows:

$$\alpha o=(109/71)\times(7/11)<1$$

As described above, the steady period ratio αo in a state where the number of revolutions is constant accurately indicates actual period ratio of the reference-position signal SGT occurring due to various errors of the angle detection section 1.

The thus-obtained steady period ratio αo is, together with the period ratio α in the usual-operational state, supplied to the predicted-period calculating section 33A in the controlled-parameter calculating section 32A.

The predicted-period calculating section 33A calculates the predicted period Tex' as follows in accordance with the sum (the reference-position period T180) of the first area period T70 and the second area period T110, the period ratio α and the steady period ratio αo:

$$Tex'=(T70+T110)(\alpha-\Delta\alpha) \quad (9)$$

where $\Delta\alpha$ is an offset corresponding to the reference-position error, the offset serving as an error component of the steady period ratio $\alpha o$ which can be obtained as follows:

$$\Delta\alpha = \alpha o - 1$$

Then, the correction section 35 calculates the corrected time Ta' controlled by the timer and corresponding to the ignition timing as follows in accordance with the crank angle $\theta a$ at the ignition timing calculated by the timer control section 34 and the predicted period Tex' calculated by the predicted-period calculating section 33A:

$$Ta' = \theta a\ (Tex'/180^\circ) = \theta a\ \{(T70 + T110)(\alpha - \Delta\alpha)/180^\circ\} \quad (10)$$

Thus, the controlled-parameter calculating section 32A is able to calculate the accurate time Ta' controlled by the timer and corresponding to the ignition timing in which the offset $\Delta\alpha$ occurring due to the error of the reference position is compensated.

It should be noted that the predicted period Tex' can be obtained from an equation different from Equation (9). For example, $(\alpha/\alpha o)$ is used in place of $(\alpha - \Delta\alpha)$ in Equation (9) such that:

$$Tex' = (T70 + T180) \cdot \alpha/\alpha o \quad (11)$$

The predicted period Tex' may be set in the foregoing manner to obtain a similar result.

The time Ta' controlled by the timer and corresponding to the ignition timing obtained from Equation (10) is, together with the power-supply commencement timing Ton, supplied to the power transistor 4 to serve as the controlled-parameter. As a result, the coil current I in the form as shown in FIG. 6 is allowed to flow in the primary coil 5a of the ignition coil 5.

At this time, the coil current I is allowed to flow in a period from the desired power-supply commencement timing Ton to $\theta a$ calculated by the timer control section 34. As a result, the cylinder is not controlled at the ignition timing with an abnormal advance, and therefore the damage of the internal combustion engine can be prevented.

Since the predicted-period calculating section 33A calculates the predicted period Tex' in accordance with the period ratio $\alpha$ of the first area period T70 and the second area period T110, which are shorter than the reference-position period T180, predicted period Tex' capable of following rapid accerelation/decerelation made during usual running can be obtained.

As described above, according to a first aspect of the present invention, there is provided an apparatus for controlling an internal combustion engine comprising: ignition coils for sequentially burning mixed gas in a plurality of cylinders for rotating the internal combustion engine; angle detection means for generating a reference-position signal indicating a reference position corresponding to a reference crank angle for each of the cylinders; a variety of sensors for detecting a state of operation of the internal combustion engine; timer control means for setting a controlled-parameter for the internal combustion engine in accordance with the reference-position signal and the state of operation; controlled-time setting means for converting the controlled-parameter into a time controlled by a timer; period measuring means for measuring a period of a plurality of reference-position areas of the reference-position signal and a plurality of area periods corresponding to the cylinders; angular error detection means for detecting an angular error of each reference-position area in accordance with the reference-position area period and the area period corresponding to the cylinder; and error discrimination means for discriminating the validity of the angular error to generate a final angular error, wherein the timer control means corrects the controlled-parameter in accordance with the final angular error, and the controlled-time setting means corrects the time controlled by the timer in accordance with the final angular error. Thus, the angular error of each reference-position area is compensated so that an effect is obtained in that there can be provided an apparatus for controlling an internal combustion engine which is capable of automatically correcting the error of the reference position, preventing an erroneous calculation of the controlled-parameter and realizing accurate control.

According to a second aspect of the present invention, there is provided an apparatus for controlling an internal combustion engine according to the first aspect wherein the error discrimination means includes storage means for storing the plural angular errors while updating the angular errors, addition means that adds the angular errors in the area periods corresponding to the cylinders to generate a sum of the errors, comparison means for generating a steadiness discrimination signal if the sum of the errors is smaller than a steadiness discrimination value and output means that responds to the steadiness discrimination signal to transmit contents of the storage means as a final angular error. Thus, an effect can be obtained in that there can be provided an apparatus for controlling an internal combustion engine which is capable of automatically correcting the error of the reference position, preventing an erroneous calculation of the controlled-parameter and realizing accurate control.

According to a third aspect of the present invention, there is provided an apparatus for controlling an internal combustion engine according to the first or second aspect of the present invention further comprising: cylinder discrimination means for generating a cylinder discrimination signal in accordance with the angular error, wherein the cylinder discrimination means includes comparison means for generating the cylinder discrimination signal if the angular error is larger than a cylinder discrimination value, at least one of the reference-position area periods of the reference-position signal relating to a specific cylinder is different from the reference-position area period of other cylinders and the timer control means identifies each cylinder in accordance with the cylinder discrimination signal. Therefore, an effect can be obtained in that an apparatus for controlling an internal combustion engine can be provided which is capable of preventing an erroneous calculation of the controlled-parameter to realize accurate control, and omitting individual cylinder discrimination signals to simplify the angle detection means.

According to a fourth aspect of-the present invention, there is provided an apparatus for controlling an internal combustion engine comprising: ignition coils for sequentially burning mixed gas in a plurality of cylinders for rotating the internal combustion engine; angle detection means for generating a reference-position signal indicating a first reference position and a second reference position corresponding to a reference crank position of each of the cylinders; a variety of sensors for detecting a state of operation of the internal combustion engine; controlled-parameter calculating means for setting a controlled-parameter for the ignition coil in accordance with the reference-position signal and the state of operation; first-area-period measuring means for measuring a first area period from the first reference position to the second reference position; second-area-period measuring means for measuring a second area period from the second reference position to the first reference position; steadiness discrimination means for discriminating a steady state of the internal combustion engine in accordance with at least any one of the first area period, the second area period and the state of operation; and period ratio calculating means for calculating a period ratio of the first area period and the second area period and obtaining a period ratio of the internal combustion engine in a steady state as a steady period ratio, wherein the controlled-parameter calculating means includes predicted-period calculating means for calculating a predicted period in accordance with the first area period, the second area period, the period ratio and the steady period ratio and correction means for correcting the controlled-parameter in accordance with the predicted period. Since the error of the reference position is, as the offset, obtained in accordance with the steady period ratio and the controlled-parameter is so corrected as to compensate the error of the reference position, an effect can be obtained in that an apparatus for controlling an internal combustion engine can be provided which is capable of preventing an erroneous calculation of the controlled-parameter to realize accurate control.

What is claimed is:

1. An apparatus for controlling an internal combustion engine comprising:

ignition coils for sequentially burning mixed gas in a plurality of cylinders for rotating said internal combustion engine;

angle detection means for generating a reference-position signal indicating a reference position corresponding to a reference crank angle for each of said cylinders;

a variety of sensors for detecting a state of operation of said internal combustion engine;

timer control means for setting a controlled-parameter for said internal combustion engine in accordance with said reference-position signal and said state of operation;

controlled-time setting means for converting said controlled-parameter into a time controlled by a timer;

period measuring means for measuring a period of a plurality of reference-position areas of said reference-position signal and a plurality of area periods corresponding to said cylinders;

angular error detection means for detecting an angular error of each reference-position area in accordance with said reference-position area period and said area period corresponding to said cylinder; and error discrimination means for discriminating the validity of said angular error to generate a final angular error, wherein said timer control means corrects said controlled-parameter in accordance with said final angular error, and said controlled-time setting means corrects said time controlled by said timer in accordance with said final angular error.

2. An apparatus for controlling an internal combustion engine according to claim 1 further comprising:

cylinder discrimination means for generating a cylinder discrimination signal in accordance with said angular error, wherein said cylinder discrimination means includes comparison means for generating said cylinder discrimination signal if said angular error is larger than a cylinder discrimination value, at least one of said reference-position area periods of said reference-position signal relating to a specific cylinder is different from the reference-position area period of other cylinders and said timer control means identifies each cylinder in accordance with said cylinder discrimination signal.

3. An apparatus for controlling an internal combustion engine according to claim 1 wherein said error discrimination means includes storage means for storing said plural angular errors while updating said angular errors, addition means that adds said angular errors in said area periods corresponding to said cylinders to generate a sum of said errors, comparison means for generating a steadiness discrimination signal if said sum of said errors is smaller than a steadiness discrimination value and output means that responds to said steadiness discrimination signal to transmit contents of said storage means as a final angular error.

4. An apparatus for controlling an internal combustion engine according to claim 3 further comprising:

cylinder discrimination means for generating a cylinder discrimination signal in accordance with said angular error, wherein said cylinder discrimination means includes comparison means for generating said cylinder discrimination signal if said angular error is larger than a cylinder discrimination value, at least one of said reference-position area periods of said reference-position signal relating to a specific cylinder is different from the reference-position area period of other cylinders and said timer control means identifies each cylinder in accordance with said cylinder discrimination signal.

5. An apparatus for controlling an internal combustion engine comprising:

ignition coils for sequentially burning mixed gas in a plurality of cylinders for rotating said internal combustion engine;

angle detection means for generating a reference-position signal indicating a first reference position and a second reference position corresponding to a reference crank position of each of said cylinders;

a variety of sensors for detecting a state of operation of said internal combustion engine;

controlled-parameter calculating means for setting a controlled-parameter for said ignition coil in accordance with said reference-position signal and said state of operation;

first-area-period measuring means for measuring a first area period from said first reference position to said second reference position;

second-area-period measuring means for measuring a second area period from said second reference position to said first reference position;

steadiness discrimination means for discriminating a steady state of said internal combustion engine in accordance with at least any one of said first area period, said second area period and said state of operation; and period ratio calculating means for calculating a period ratio of said first area period and said second area period and obtaining a period ratio of said internal combustion engine in a steady state as a steady period ratio, wherein said controlled-parameter calculating means includes predicted-period calculating means for calculating a predicted period in accordance with said first area period, said second area period, said period ratio and said steady period ratio and correction means for correcting said controlled-parameter in accordance with said predicted period.

* * * * *